US010611169B2

(12) United States Patent
Ohtsu

(10) Patent No.: US 10,611,169 B2
(45) Date of Patent: Apr. 7, 2020

(54) DIAPHRAGM PUMP, LIQUID CIRCULATION MODULE AND LIQUID DISCHARGE APPARATUS

(71) Applicant: TOSHIBA TEC KABUSHIKI KAISHA, Shinagawa-ku, Tokyo (JP)

(72) Inventor: Kazuhiko Ohtsu, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/218,580

(22) Filed: Dec. 13, 2018

(65) Prior Publication Data

US 2019/0193396 A1 Jun. 27, 2019

(30) Foreign Application Priority Data

Dec. 22, 2017 (JP) ..... 2017-246354

(51) Int. Cl.

| | |
|---|---|
| ***B41J 2/175*** | (2006.01) |
| ***B41J 2/045*** | (2006.01) |
| ***B41J 2/14*** | (2006.01) |
| ***B41J 2/18*** | (2006.01) |
| ***B41J 29/38*** | (2006.01) |

(52) U.S. Cl.

CPC ..... *B41J 2/17596* (2013.01); *B41J 2/04581* (2013.01); *B41J 2/14201* (2013.01); *B41J 2/14233* (2013.01); *B41J 2/18* (2013.01); *B41J 29/38* (2013.01); *B41J 2/04541* (2013.01); *B41J 2202/12* (2013.01)

(58) Field of Classification Search

CPC .... B41J 2/17596; B41J 2/14233; B41J 29/38; B41J 2/18; B41J 2/14201; B41J 2/04581; B41J 2202/12; B41J 2/04541

See application file for complete search history.

(56) References Cited

U.S. PATENT DOCUMENTS

| | | | | |
|---|---|---|---|---|
| 9,205,665 | B2 | 12/2015 | Kaneko | |
| 2009/0091779 | A1* | 4/2009 | Ishinaga | B41J 2/175 358/1.15 |
| 2009/0262153 | A1* | 10/2009 | Tamaki | B41J 2/175 347/7 |
| 2009/0295888 | A1* | 12/2009 | Nitta | B41J 2/175 347/89 |

(Continued)

FOREIGN PATENT DOCUMENTS

| | | |
|---|---|---|
| JP | 59-87286 | 5/1984 |
| JP | 2015-116753 | 6/2015 |

(Continued)

*Primary Examiner* — Justin Seo

(74) *Attorney, Agent, or Firm* — Amin, Turocy & Watson, LLP

(57) ABSTRACT

In accordance with an embodiment, a diaphragm pump comprises a main liquid chamber; a main actuator configured to change a volume of the main liquid chamber; a sub liquid chamber configured to communicate with a primary side or a secondary side of the main liquid chamber; a sub actuator configured to change a volume of the sub liquid chamber; a first check valve provided on the primary side of the main liquid chamber; a second check valve provided on the secondary side of the main liquid chamber; and a controller configured to control the main actuator and the sub actuator.

20 Claims, 9 Drawing Sheets

(56) References Cited

U.S. PATENT DOCUMENTS

| | | | | |
|---|---|---|---|---|
| 2010/0020139 | A1* | 1/2010 | Yokouchi | B41J 2/175 347/85 |
| 2016/0059547 | A1 | 3/2016 | Kaneko | |
| 2016/0208791 | A1* | 7/2016 | Reeh | F04B 19/24 |
| 2018/0072069 | A1 | 3/2018 | Hara et al. | |
| 2018/0178537 | A1 | 6/2018 | Murata et al. | |

FOREIGN PATENT DOCUMENTS

| | | |
|---|---|---|
| JP | 2017-132119 | 8/2017 |
| JP | 6377547 | 8/2018 |

* cited by examiner

DIAPHRAGM PUMP, LIQUID CIRCULATION MODULE AND LIQUID DISCHARGE APPARATUS

CROSS-REFERENCE TO RELATED APPLICATION

This application is based upon and claims the benefit of priority from Japanese Patent Application No. P2017-246354, filed Dec. 22, 2017, the entire contents of which are incorporated herein by reference.

FIELD

Embodiments described herein relate generally to a diaphragm pump, a liquid circulation module and a liquid discharge apparatus.

BACKGROUND

A conventional inkjet recording apparatus having an ink circulation type of an inkjet head capable of preventing deterioration of ink and settling of color material and capable of improving discharge stability of the ink as a liquid discharge apparatus is known. The inkjet recording apparatus includes an ink supply circulation module which supplies ink in an ink tank to the inkjet head and returns the ink supplied to the inkjet head to the ink tank without making the ink stay in the vicinity of a nozzle to circulate the ink in a circulation circuit.

The ink supply circulation module is a diaphragm pump for conveying fluid by combining a reciprocating motion of a diaphragm made of a piezoelectric member, a rubber, a thermoplastic resin or Teflon (registered trademark) and an operation of a check valve made of resin to supply the ink in the ink tank to the inkjet head.

In the diaphragm pump which conveys the liquid through the reciprocating motion of the diaphragm, suction and discharge of the liquid are alternately performed, and the liquid flows intermittently, and thus, pulsation is generated. There is a possibility that the pulsation disturbs a negative pressure for forming a meniscus in the nozzle of the inkjet head, resulting in disorder of ink droplets discharged from the nozzle.

DETAILED DESCRIPTION

Figure 1:
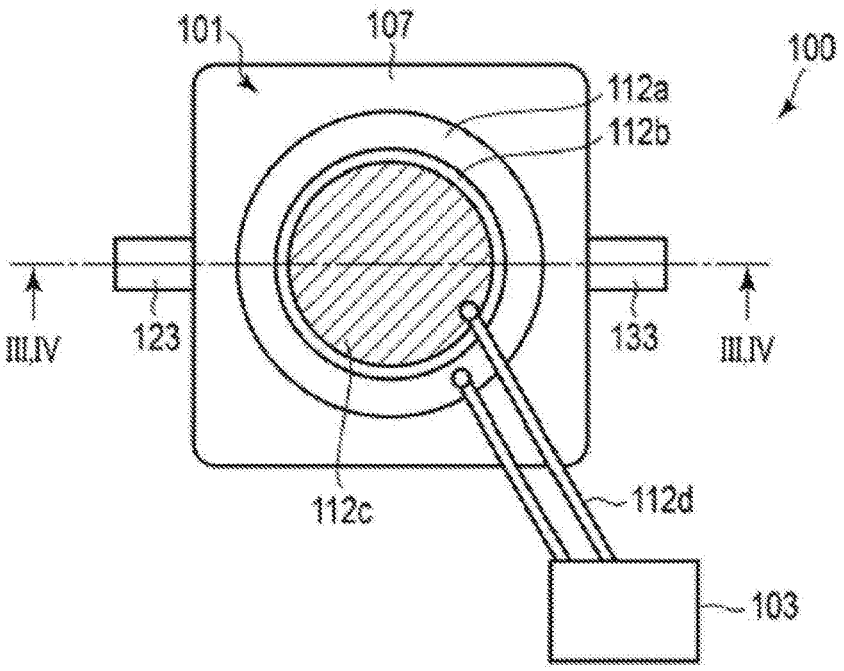
FIG. 1 is a plan view illustrating a configuration of a diaphragm pump according to an embodiment.
Figure 2:
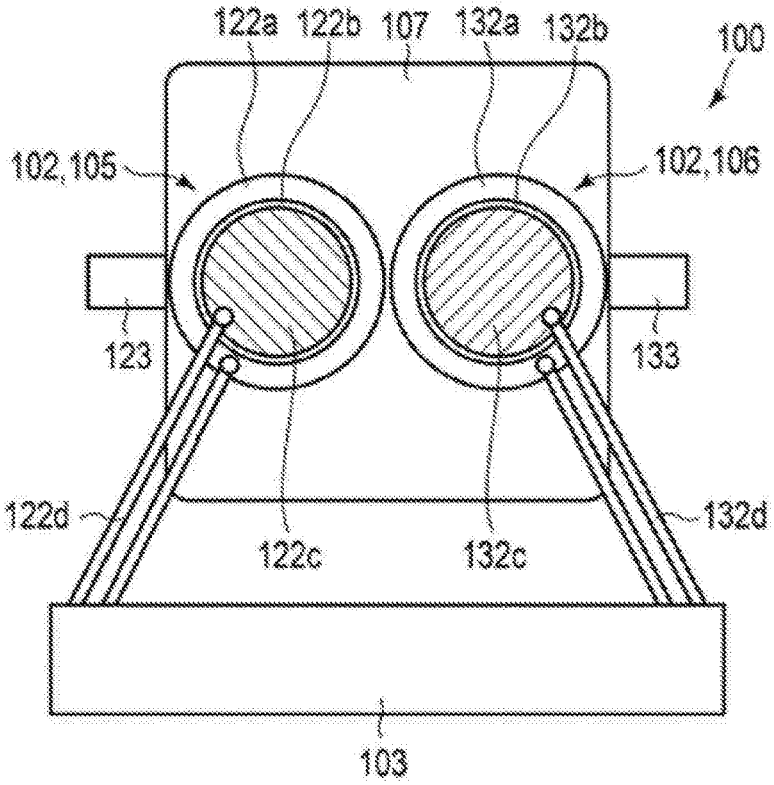
FIG. 2 is a bottom view illustrating a configuration of the diaphragm pump.

In accordance with an embodiment, a diaphragm pump comprises a main liquid chamber; a main actuator configured to change a volume of the main liquid chamber; a sub liquid chamber configured to communicate with a primary side or a secondary side of the main liquid chamber; a sub actuator configured to change a volume of the sub liquid chamber; a first check valve provided on the primary side of the main liquid chamber; a second check valve provided on the secondary side of the main liquid chamber; and a controller configured to control the main actuator and the sub actuator.

Hereinafter, a diaphragm pump 100 and an inkjet recording apparatus 1 using the diaphragm pump 100 according to an embodiment are described with reference to FIG. 1 to FIG. 13.

(Diaphragm Pump 100)

The diaphragm pump 100 comprises a main pump 101, a sub pump 102 provided on at least one of a primary side and a secondary side of the main pump 101, and a controller 103 controlling the main pump 101 and the sub pump 102.

The diaphragm pump 100 is a general-purpose piezoelectric pump which conveys various kinds of liquid such as ink, medicine, analytical reagent and the like. In the present embodiment, the diaphragm pump 100 conveys the ink as the liquid. The diaphragm pump 100 is mounted on the inkjet recording apparatus 1 which is a liquid discharge apparatus.

In the present embodiment, the diaphragm pump 100 includes the sub pumps 102 on both the primary side and the secondary side of the main pump 101. Hereinafter, the sub pump 102 on the primary side of the main pump 101 is referred to as a first sub pump 105, and the sub pump 102 on the secondary side of the main pump 101 is described as a second sub pump 106.

As shown in FIG. 1 to FIG. 4, the main pump 101 includes a main liquid chamber 111, a main actuator 112, a first communication hole 113, a first check valve 114, a second communication hole 115 and a second check valve 116.

For example, the main liquid chamber 111 has a columnar space in which a length in an axial direction is smaller than that in a radial direction, and has an opening 111*a* in which the main actuator 112 is provided at an end in the axial direction thereof. In the main liquid chamber 111, the first communication hole 113 and the second communication hole 115 respectively connected with the primary side and the secondary side of the main liquid chamber 111 are arranged on an end surface of the main liquid chamber 111 in the axial direction opposite to the opening 111*a*.

The main actuator 112 seals the opening 111*a* of the main liquid chamber 111 to form an internal space of the main liquid chamber 111. The main actuator 112 reciprocates in a direction to decrease or increase the volume of the internal space of the main liquid chamber 111.

The main actuator 112 is, for example, a disk-shaped piezoelectric member. As a specific example, the main actuator 112 includes a metal plate 112*a*, a piezoelectric ceramic 112*b* fixed on the metal plate 112*a*, and an electrode 112*c* provided on the piezoelectric ceramic 112*b*. For example, the main actuator 112 operates in a range in which an operation voltage of the main actuator 112 is from AC 1 mV to AC 200 V and a frequency is from 1 mHz to 200 Hz.

The metal plate 112*a* is, for example, a circular disk made of a stainless steel material having a diameter of 30 mm and a thickness of 0.2 mm. A surface of the metal plate 112*a* facing the main liquid chamber 111 has a coating layer made of a resin material to prevent direct contact with the ink. The metal plate 112*a* is connected to the controller 103 via a wiring 112*d*.

The metal plate 112*a* is not limited to a stainless steel material, and may be made of a material such as nickel, brass, gold, silver, copper, or the like.

The piezoelectric ceramic 112*b* is a circular disk made of PZT (lead zirconate titanate) having a diameter of 25 mm and a thickness of 0.4 mm. The piezoelectric ceramic 112*b* is fixed to an outer surface of the metal plate 112*a*, i.e., a surface opposite the surface on the side of the main liquid chamber 111 by an adhesive or the like. The piezoelectric ceramic 112*b* is polarized in a thickness direction thereof, and expands and contracts in a surface direction to expand or contract the main liquid chamber 111 when an electric field is applied in the thickness direction. Specifically, the piezoelectric ceramic 112*b* expands and contracts in the surface direction thereof when an AC voltage is applied thereto in the thickness direction thereof, and the metal plate 112*a* is deformed due to deformation of the piezoelectric ceramic 112*b*, thereby increasing and decreasing the volume of the main liquid chamber 111.

The electrode 112*c* is made of silver paste applied on the piezoelectric ceramic 112*b*. The electrode 112*c* is connected to the controller 103 via the wiring 112*d*.

The first communication hole 113 fluidically connects the main liquid chamber 111 to the first sub pump 105.

The first check valve 114 is provided in the middle of the first communication hole 113. The first check valve 114 prevents reverse flow of the ink from the main liquid chamber 111 to the first sub pump 105 on the primary side. As a specific example, the first check valve 114 includes a first valve chest 114*a* provided in the first communication hole 113 and a first valve body 114*b* accommodated in the first valve chest 114*a*. The first valve chest 114*a* accommodates the first valve body 114*b* in such a manner that the first valve body 114*b* can reciprocate in one direction.

The first valve chest 114*a* has a bearing surface that abuts against the first valve body 114*b* to seal the first communication hole 113 when the first valve body 114*b* moves towards the primary side of the first communication hole 113. The first valve chest 114*a* has a support surface which abuts against the first valve body 114*b* and constitutes a flow path through which the ink flows when the first valve body 114*b* moves towards the secondary side of the first communication hole 113. For example, the support surface has a recess a part of which communicates with the first communication hole 113, and a hole connecting the first valve chest 114*a* to the recess. When the first valve body 114*b* abuts against the bearing surface of the first valve chest 114*a*, the first valve body 114*b* seals the first communication hole 113.

The first valve body 114*b* is made of a material resistant to the liquid to be conveyed. In the present embodiment, the first valve body 114*b* is made of, for example, a polyimide material. This is because the polyimide material is resistant to various kinds of ink materials such as water-based ink, oil-based ink, volatile solvent ink, UV (ultraviolet) ink and the like discharged by the inkjet recording apparatus 1. In place of the polyimide material, the first valve body 114*b* may be made of various kinds of material, for example, resin or metal having strong resistance to the ink such as PET (polyethylene terephthalate), ultrahigh molecular weight PE (polyethylene), PP (polypropylene), PPS (polyphenylene sulfide), PEEK Polyetheretherketone), PFA (tetrafluoroethylene.perfluoroalkylvinylether copolymer), FEP (tetrafluoroethylene.hexafluoropropylene copolymer), ETFE (tetrafluoroethylene.ethylene copolymer), PTFE (poly Tetrafluoroethylene), aluminum, stainless steel, nickel and the like.

The first valve body 114*b* has a thickness of, for example, about several μm to 1 mm. For example, the first valve body 114*b* is made of a polyimide material of which a Young's modulus is 4*109 (Pa), and an outer shape thereof is a square shape with a thickness of 0.03 mm and a width of 9 mm. The first valve body 114*b* translates in the first valve chest 114*a* along a direction of flow due to the flow of the liquid.

The second communication hole 115 fluidically connects the main liquid chamber 111 to the second sub pump 106.

The second check valve 116 is provided in the middle of the second communication hole 115. The second check valve 116 prevents reverse flow of the ink from the second sub pump 106 to the main liquid chamber 111 on the primary side. As a specific example, the second check valve 116 includes a second valve chest 116*a* provided in the second communication hole 115 and a second valve body 116*b* accommodated in the second valve chest 116*a*. The second valve chest 116*a* accommodates the second valve body 116*b* in such a manner that the second valve body 116*b* can reciprocate in one direction.

The second valve chest 116*a* has a bearing surface that abuts against the second valve body 116*b* to seal the second communication hole 115 when the second valve body 116*b* moves towards the primary side of the second communication hole 115. The second valve chest 116*a* has a support surface which abuts against the second valve body 116*b* and constitutes a flow path through which the ink flows when the second valve body 116*b* moves towards the secondary side of the second communication hole 115. For example, the support surface has a recess a part of which communicates with the second communication hole 115, and a hole connecting the second valve chest 116*a* to the recess. When the second valve body 116*b* abuts against the bearing surface of the second valve chest 116*a*, the second valve body 116*b* seals the second communication hole 115.

The second valve body 116*b* is made of a material resistant to the conveyed liquid. In the present embodiment, the second valve body 116*b* is made of the same material and formed into the same shape as the first valve body 114*b*. The material and the shape of the first valve body 114*b* and the second valve body 116*b* may be not the same, and the material thereof can be selected from the above resin or metal as appropriate.

The first sub pump 105 includes a first sub liquid chamber 121, a first sub actuator 122, and a suction section 123 provided in the first sub liquid chamber 121.

The first sub liquid chamber 121 is provided on the primary side of the main liquid chamber 111. The first sub liquid chamber 121 has a columnar space in which a length in an axial direction thereof is smaller than that in a radial direction thereof, and has an opening 121*a* in which the first sub actuator 122 is provided at an end in the axial direction thereof. The first sub liquid chamber 121 is provided with the first communication hole 113 on an end surface in the axial direction thereof facing the opening 121*a*, and the suction section 123 in a part of an outer peripheral surface.

The first sub actuator 122 is, for example, a disk-shaped piezoelectric member. The first sub actuator 122 seals the opening 121*a* of the first sub liquid chamber 121, and forms an internal space of the first sub liquid chamber 121 together with the first sub liquid chamber 121. The first sub actuator 122 reciprocates in a direction to decrease or increase the volume of the internal space of the first sub liquid chamber 121.

The first sub actuator 122 has the same configuration as the main actuator 112, for example. The outer diameter of the first sub actuator 122 is the same as or slightly smaller than that of the main actuator 112.

For example, the first sub actuator 122 is a disk-shaped piezoelectric member. The first sub actuator 122 includes a metal plate 122*a*, a piezoelectric ceramic 122*b* fixed onto the metal plate 122*a*, and an electrode 122*c* provided on the piezoelectric ceramic 122*b*.

For example, the metal plate 122*a* is a circular disk made of a stainless steel material having a diameter of 30 mm and a thickness of 0.2 mm. A surface of the metal plate 122*a* on the first sub liquid chamber 121 side has a coating layer made of a resin material to prevent direct contact with the ink. The metal plate 122*a* is connected to the controller 103 via a wiring 122*d*.

The material of the metal plate 122*a* is not limited to a stainless steel material, and may also be a material such as nickel, brass, gold, silver, copper, or the like.

The piezoelectric ceramic 122*b* is a circular disk made of PZT having a diameter of 25 mm and a thickness of 0.4 mm. The piezoelectric ceramic 122*b* is fixed to an outer surface of the metal plate 122*a*, i.e., a surface opposite to the surface on the first sub liquid chamber 121 side of the metal plate 122*a* by an adhesive or the like. The piezoelectric ceramic 122*b* is polarized in a thickness direction thereof, and when an electric field is applied in the thickness direction, the piezoelectric ceramic 122*b* expands and contracts in a surface direction to expand or contract the first sub liquid chamber 121. Specifically, the piezoelectric ceramic 122*b* expands and contracts in the surface direction when an AC voltage is applied in the thickness direction thereof, and the metal plate 122*a* is deformed due to deformation of the piezoelectric ceramic 122*b*, thereby increasing and decreasing the volume of the first sub liquid chamber 121.

The electrode 122*c* is made of a silver paste applied on the piezoelectric ceramic 122*b*. The electrode 122*c* is connected to the controller 103 via the wiring 122*d*.

The second sub pump 106 includes a second sub liquid chamber 131, a second sub actuator 132, and a discharge section 133 provided in the second sub liquid chamber 131.

The second sub liquid chamber 131 is provided on the secondary side of the main liquid chamber 111. The second sub liquid chamber 131 has a columnar space in which a length in an axial direction thereof is smaller than that in a radial direction thereof, and has an opening 131*a* in which the second sub actuator 132 is provided at an end in the axial direction thereof. The second sub liquid chamber 131 is provided with the second communication hole 115 on an end surface in the axial direction thereof facing the opening 131*a*, and the discharge section 133 in a part of an outer peripheral surface.

The second sub actuator 132 is, for example, a disk-shaped piezoelectric member. The second sub actuator 132 seals the opening 131*a* of the second sub liquid chamber 131, and forms an internal space of the second sub liquid chamber 131 together with the second sub liquid chamber 131. The second sub actuator 132 reciprocates in a direction to decrease or increase the volume of the internal space of the second sub liquid chamber 131.

The second sub actuator 132 has the same configuration as the first sub actuator 122, for example. For example, the second sub actuator 132 is a disk-shaped piezoelectric member. The second sub actuator 132 includes a metal plate 132*a*, a piezoelectric ceramic 132*b* fixed onto the metal plate 132*a*, and an electrode 132*c* provided on the piezoelectric ceramic 132*b*.

For example, the metal plate 132*a* is a circular disk made of a stainless steel material having a diameter of 30 mm and a thickness of 0.2 mm. A surface of the metal plate 132*a* on the second sub liquid chamber 131 side has a coating layer made of a resin material to prevent direct contact with the ink. The metal plate 132*a* is connected to the controller 103 via a wiring 132*d*.

The material of the metal plate 132*a* is not limited to a stainless steel material, and may also be a material such as nickel, brass, gold, silver, copper, or the like.

The piezoelectric ceramic 132*b* is a circular disk made of PZT having a diameter of 25 mm and a thickness of 0.4 mm. The piezoelectric ceramic 132*b* is fixed to an outer surface of the metal plate 132*a*, i.e., a surface opposite to the surface on the second sub liquid chamber 131 side of the metal plate 132*a* by an adhesive or the like. The piezoelectric ceramic 132*b* is polarized in a thickness direction thereof, and when an electric field is applied in the thickness direction, the piezoelectric ceramic 132*b* expands and contracts in a surface direction to expand or contract the second sub liquid chamber 131. Specifically, the piezoelectric ceramic 132*b* expands and contracts in the surface direction when an AC voltage is applied in the thickness direction thereof, and the metal plate 132*a* is deformed due to deformation of the piezoelectric ceramic 132*b*, thereby increasing and decreasing the volume of the second sub liquid chamber 131.

The electrode 132*c* is made of a silver paste applied on the piezoelectric ceramic 132*b*. The electrode 132*c* is connected to the controller 103 via the wiring 132*d*.

The material of the piezoelectric ceramics 112*b*, 122*b* and 132*b* is not limited to PZT, and may be PTO ($PbTiO_3$:lead titanate), PMNT (Pb $(Mg_{1/3}Nb_{2/3})O_3$—$PbTiO_3)_r$ PZNT (Pb $(Zn_{1/3}N_{2/3})O_3$—$PbTiO_3$), ZnO, AlN, or the like.

The controller 103 is connected to a drive circuit of a device provided with the diaphragm pump 100, for example. The controller 103 controls the drive circuit of the diaphragm pump 100 and other drive circuits. The controller 103 supplies the AC voltage to the main actuator 112, the first sub actuator 122, and the second sub actuator 132, which are all the piezoelectric members.

The controller 103 operates the main actuator 112 by supplying the AC voltage to the main actuator 112 at a predetermined interval to continuously increase or decrease the volume of the main liquid chamber 111. As a result, by controlling the main actuator 112 by the controller 103, the ink is sucked from the primary side to the main liquid chamber 111 and is discharged to the secondary side.

The controller 103 operates the first sub actuator 122 and the second sub actuator 132 by supplying the AC voltage to the first sub actuator 122 and the second sub actuator 132 at a predetermined interval to continuously increase or decrease volumes of the first sub liquid chamber 121 and the second sub liquid chamber 131. The controller 103 drives the first sub actuator 122 and the second sub actuator 132 in an opposite phase or in a phase slight shifted from the opposite phase with respect to a phase in which the main actuator 112 sucks and discharges the ink.

For example, the controller 103 operates the main actuator 112 with an AC voltage having a frequency of 100 Hz and a voltage of 100 V. For example, the controller 103 operates the first sub actuator 122 and the second sub actuator 132 with an AC voltage having a frequency of 100 Hz and a voltage of 100 V or 80 V.

For example, the controller 103 operates the main actuator 112 with an AC voltage having a frequency of 100 Hz and a voltage of 100 V.

In the diaphragm pump 100 configured as described above, for example, the main actuator 112, the first valve body 114*b*, the second valve body 116*b*, the first sub actuator 122, and the second sub actuator 132 are installed in a housing 107.

Specifically, in the housing 107, the main liquid chamber 111, the first communication hole 113, the first valve chest 114*a*, the second communication hole 115, the second valve chest 116*a*, the first sub liquid chamber 121, the suction section 123, the second sub liquid chamber 131 and the second sub liquid chamber 131 are formed. For example, the housing 107 includes two housings 107*a* and 107*b* divided at a position where each of the first valve chest 114*a* and the second valve chest 116*a* is divided into two in such a manner that the first valve body 114*b* and the second valve body 116*b* can be arranged in the first valve chest 114*a* and the second valve chest 116*a*. Specifically, the housing 107 includes the first housing 107*a* and the second housing 107*b*, and is formed by combining the first housing 107*a* and the second housing 107*b*. The first housing 107*a* and the second housing 107*b* each are made of, for example, PPS resin.

The first housing 107*a* includes the main liquid chamber 111, a part of the first communication hole 113 for connecting the main liquid chamber 111 with the first valve chest 114*a*, a part where the recess is formed on the secondary side of the first valve chest 114*a*, a part of the second communication hole 115 for connecting the main liquid chamber 111 with the second valve chest 116*a*, and a part facing the recess on the primary side of the second valve chest 116*a*.

The second housing 107*b* includes a part facing the recess on the primary side of the first valve chest 114*a*, a part of the first communication hole 113 for connecting the first sub liquid chamber 121 with the first valve chest 114, the first sub liquid chamber 121, the suction section 123, a part where the recess is formed on the secondary side of the second valve chest 116*a*, a part of the second communication hole 115 for connecting the second sub liquid chamber 131 with the second valve chest 116*a*, the second sub liquid chamber 131 and the discharge section 133.

Figure 5:
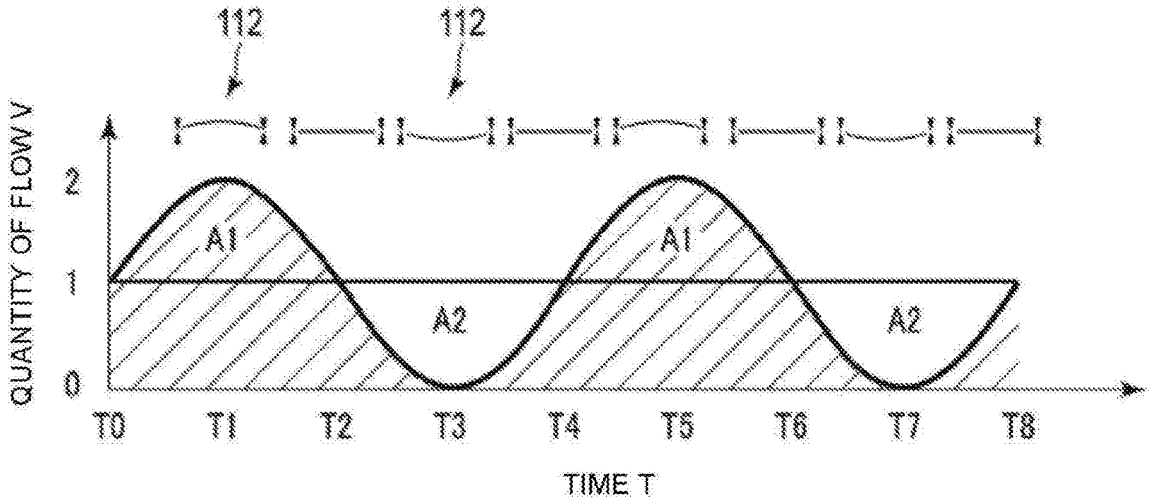
FIG. 5 is a diagram illustrating a relationship between the time and a quantity of flow at which liquid flows to a main liquid chamber of the diaphragm pump.
Figure 6:
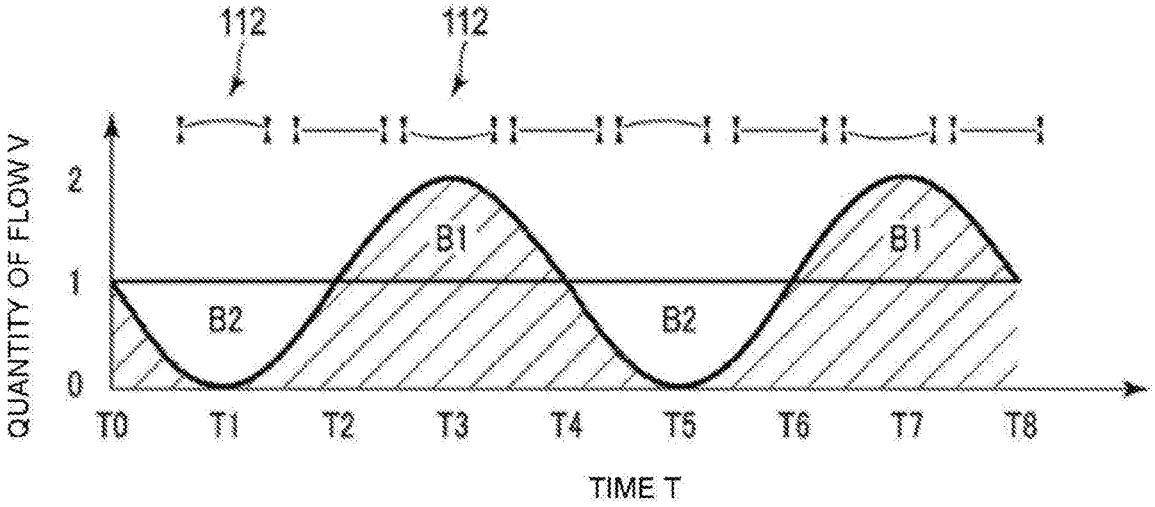
FIG. 6 is a diagram illustrating the relationship between the time and a quantity of flow at which liquid flows out to the main liquid chamber of the diaphragm pump.
Figure 7:
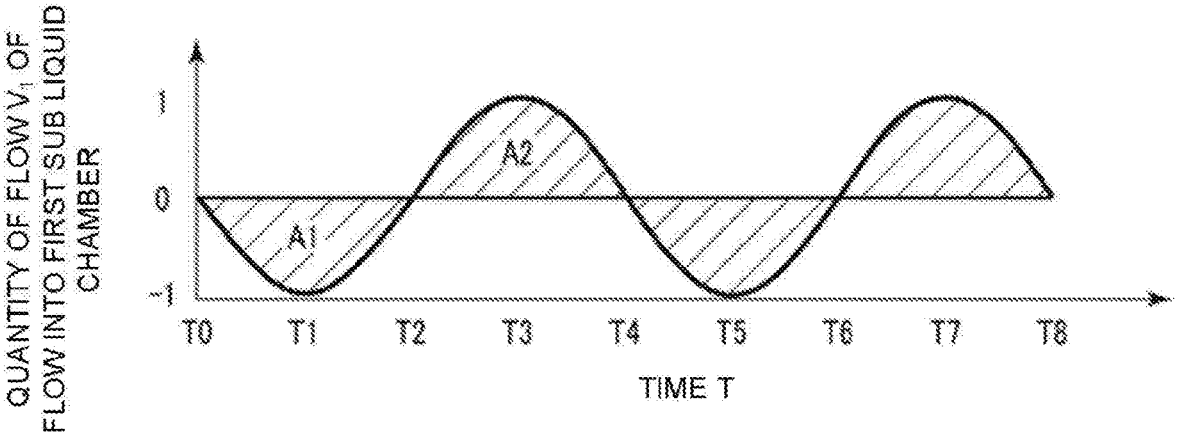
FIG. 7 is a diagram illustrating the relationship between the time and a quantity of flow at which liquid flows to a first sub liquid chamber of the diaphragm pump.
Figure 8:
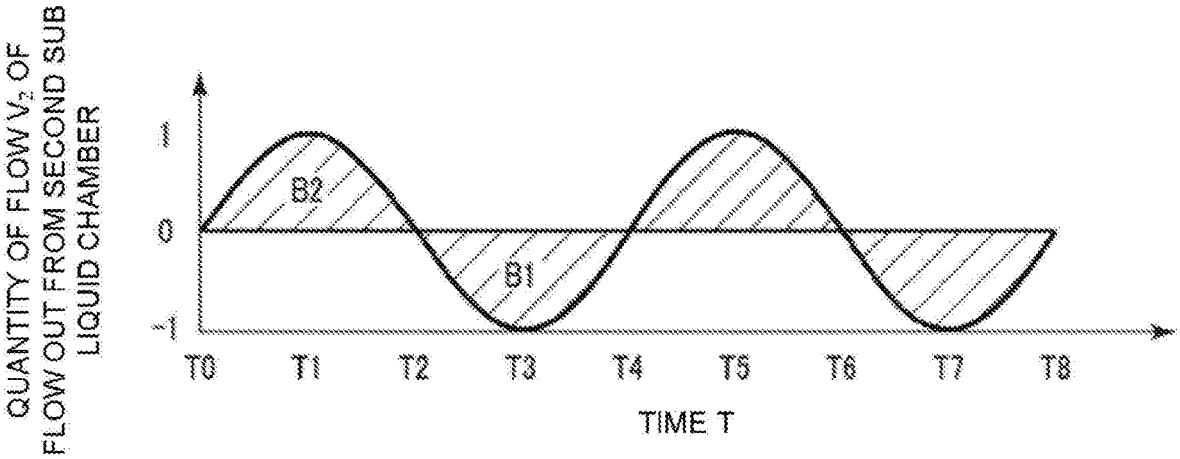
FIG. 8 is a diagram illustrating the relationship between the time and a quantity of flow at which liquid flows out to a second sub liquid chamber of the diaphragm pump.
Figure 9:
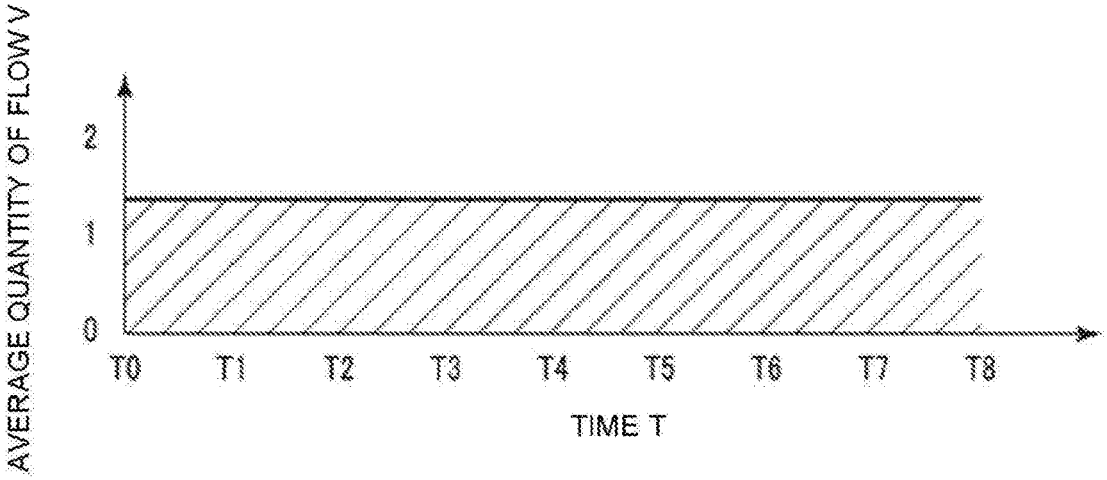
FIG. 9 is a diagram illustrating an average quantity of flow in a pulsation reduction operation of the diaphragm pump.

Next, an example of the operation of the diaphragm pump 100 configured as described above is described with reference to FIG. 5 to FIG. 9. FIG. 5 is a diagram illustrating a relationship between the time and a quantity of flow at which the liquid flows to the main liquid chamber 111 of the diaphragm pump 100 and illustrating an example of driving of the main actuator 112 at each time. FIG. 6 is a diagram illustrating a relationship between the time and the quantity of flow at which the liquid flows out to the main liquid chamber 111 of the diaphragm pump 100 and illustrating an example of driving of the main actuator 112 at each time. FIG. 7 is a diagram illustrating a relationship between the time and a quantity of flow at which the liquid flows to the first sub liquid chamber 121 of the diaphragm pump 100. FIG. 8 is a diagram illustrating a relationship between the time and a quantity of flow at which the liquid flows out to the second sub liquid chamber 131 of the diaphragm pump 100. FIG. 9 is a diagram illustrating an average quantity of flow in a pulsation reduction operation of the diaphragm pump 100. In the following description, the volumes of the liquid chambers 111, 121 and 131 when the actuators 112, 122 and 132 are not driven and are positioned in standby positions are described as steady-state volumes.

The controller 103 applies the AC voltage at a predetermined interval to the main actuator 112, the first sub actuator 122 and the second sub actuator 132 to drive the actuators 112, 122 and 132.

First, as shown in FIG. 5, the controller 103 drives the main actuator 112 to increase the volume of the main liquid chamber 111 from T0 to T1. As a result, since the volume of the main liquid chamber 111 increases, and the pressure in the main liquid chamber 111 decreases, the first check valve 114 is opened due to a pressure difference between the primary side and the secondary side of the first check valve 114, and the ink flows to the main liquid chamber 111. The second check valve 116 is closed due to a pressure difference between the primary side and the secondary side of the second check valve 116, and the flow of the ink from the main liquid chamber 111 to the secondary side is restricted.

At this time, the controller 103 drives the first sub actuator 122 in a direction to decrease the volume of the first sub liquid chamber 121 from the steady-state volume to enable the ink in the first sub liquid chamber 121 to flow to the main liquid chamber 111. In addition, the controller 103 drives the second sub actuator 132 in a direction to decrease the volume of the second sub liquid chamber 131 from the steady-state volume.

Next, the controller 103 drives the main actuator 112 such that the increased volume of the main liquid chamber 111 becomes the steady-state volume from T1 to T2, and the volume of the main liquid chamber 111 decreases from the steady-state volume at T3. As a result, since the volume of the main liquid chamber 111 decreases and the pressure in the main liquid chamber 111 increases, the first check valve 114 is closed due to the pressure difference between the primary side and the secondary side of the first check valve 114, and the flow of the ink to the main liquid chamber 111 is regulated. The second check valve 116 is opened due to the pressure difference between the primary side and the secondary side of the second check valve 116 and the ink flows out from the main liquid chamber 111 to the secondary side.

At this time, the controller 103 drives the first sub actuator 122 in a direction to increase the volume of the first sub liquid chamber 121 from the steady-state volume to enable the ink in the first sub liquid chamber 121 to flow to the main liquid chamber 111. In addition, the controller 103 drives the second sub actuator 132 in a direction to increase the volume of the second sub liquid chamber 131 from the steady-state volume.

Next, the controller 103 drives the main actuator 112 such that the decreased volume of the main liquid chamber 111 becomes steady-state volume from T3 to T4, and the volume of the main liquid chamber 111 increases from the steady-state volume at T5.

At this time, the controller 103 drives the first sub actuator 122 in a direction to decrease the volume of the first sub liquid chamber 121 from the steady-state volume to enable the ink in the first sub liquid chamber 121 to flow to the main liquid chamber 111. In addition, the controller 103 drives the second sub actuator 132 in a direction to decrease the volume of the second sub liquid chamber 131 from the steady-state volume.

As described above, the controller 103 drives the actuators 112, 122 and 132 to reciprocate to increase and decrease the volumes of the liquid chambers 111, 121 and 131, respectively, and drives the sub actuators 122 and 132 to reciprocate in such a manner that the sub actuators 122 and 132 are driven in an opposite phase with respect to the main actuator 112. Here, the driving of the sub actuators 122 and 132 in the opposite phase with respect to the main actuator 112 refers to a case of driving the sub actuators 122 and 132 in a direction to decrease the volumes of the sub liquid chambers 121 and 131 when the main actuator 112 is driven in a direction to increase the volume of the main liquid chamber 111, and a case of driving the sub actuators 122 and 132 in a direction to increase the volumes of the sub liquid chambers 121 and 131 when the main actuator 112 is driven in a direction to decrease the volume of the main liquid chamber 111.

As shown in FIG. 5, the diaphragm pump 100 configured as described above operates in a direction in which the volume of the first sub liquid chamber 121 is compressed (the volume is decreased) by the first sub actuator 122 provided in the first sub liquid chamber (suction chamber) 121 to temporarily store the quantity of flow of the ink corresponding to A1 shown in FIG. 5 in the first sub liquid chamber 121. As a result, the diaphragm pump 100 performs adjustment so that the ink does not flow to the main liquid chamber 111 at once, and operates so that the quantity of flow corresponding to the A1 shown in FIG. 5 is diverted by A2. As a result, since the quantity of the flow of the ink flowing from the suction section 123 by the main pump 101 is stabilized, a pulsation when the ink flows to the main chamber 111 can be reduced.

The effect of the pulsation reduction is described in detail below.

In the diaphragm pump 100, when the main pump 101 sucks the ink from the suction section 123, the main actuator 112 expands to expand the volume of the main liquid chamber 111 (the volume is increased). When the volume of the main liquid chamber 111 expands, an internal pressure of the main liquid chamber 111 decreases, and the liquid flows to the first sub liquid chamber (suction chamber) 121. Due to the flowing liquid, the first valve body 114*b* and the second valve body 116*b* move to the main liquid chamber 111 side. The first valve body 114*b* is stopped by the support surface of the first valve chest 114*a*, and the ink flows from the first valve chest 114*a* through the first communication hole 113 to the main liquid chamber 111. At this time, since the second valve body 116*b* seals the second communication hole 115, the ink does not flow to the second sub liquid chamber (liquid feed chamber) 131.

Figure 4:
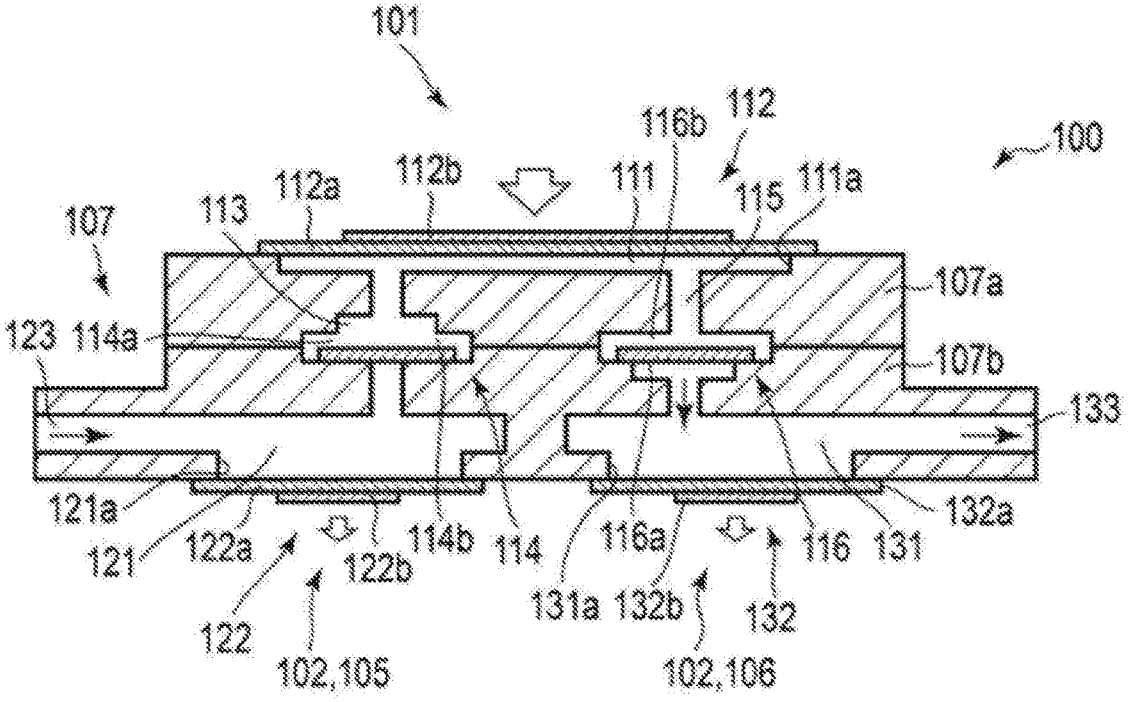
FIG. 4 is a sectional view illustrating an example of a configuration of the diaphragm pump at the time of use.

As shown in FIG. 4, in the diaphragm pump 100, when the main pump 101 discharges the ink from the discharge section 133, the main actuator 112 contracts to decrease the volume of the main liquid chamber 111. When the volume of the main liquid chamber 111 is decreased, the internal pressure of the main liquid chamber 111 rises, and the ink flows from the second communication hole 115 to the second sub liquid chamber 131. The first valve body 114*b* and the second valve body 116*b* move towards the sub liquid chambers 121 and 131 respectively due to the flow of the ink and the pressure difference, the first valve body 114*b* seals the first communication hole 113, the second valve body 116*b* is stopped by the support surface, and the ink flows to the second sub liquid chamber 131 through the second valve chest 116*a*.

As described above, the ink is conveyed in one direction through a series of operations in which the ink flowing from the suction section 123 due to driving of the main actuator 112 is discharged from the discharge section 133 through the main liquid chamber 111.

In the conveyance of the ink, if only the main actuator 112 performs simply reciprocating motion when the first sub pump 105 and the second sub pump 106 are not driven or in a case in which the sub pumps 105 and 106 are not provided, pulsations as shown in FIG. 5 and FIG. 6 occurs in the ink flowing from the suction section 123 and the ink discharged from the discharge section 133, respectively.

Figure 3:
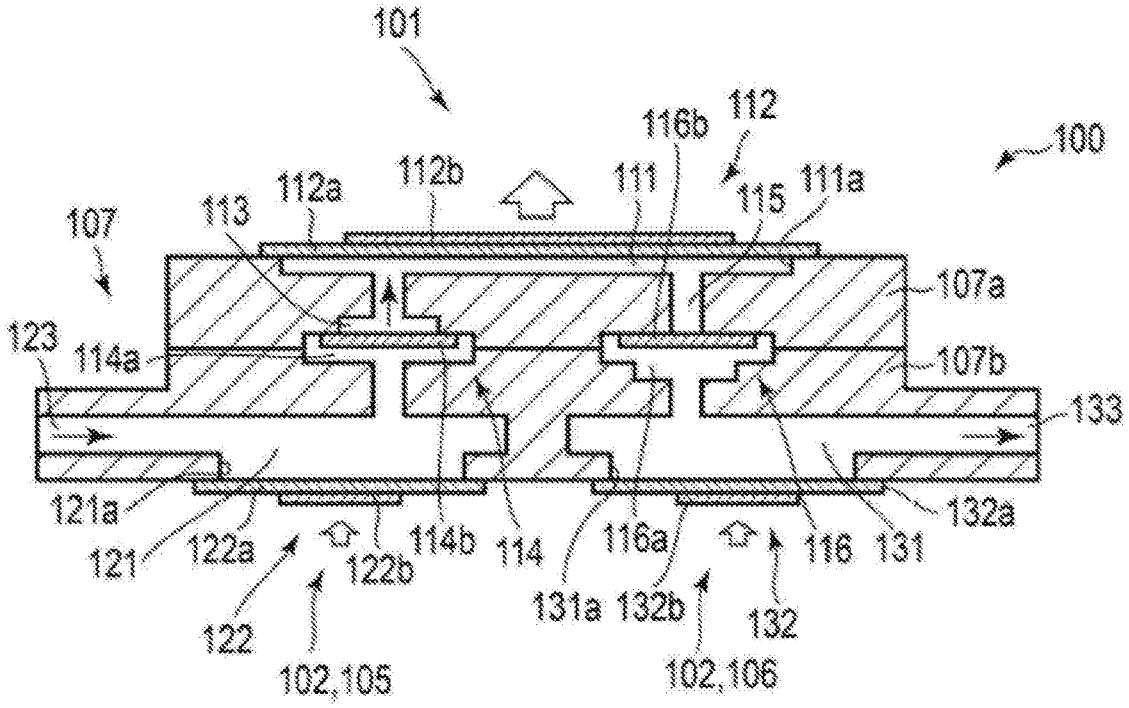
FIG. 3 is a cross-sectional view illustrating a configuration of the diaphragm pump.

As shown in FIG. 3, when the main pump 101 sucks the ink from the suction section 123, if the main actuator 112 expands to expand the volume of the main liquid chamber 111, the internal pressure of the main liquid chamber 111 decreases, and the ink flows to the first sub liquid chamber 121 at once. However, the first sub actuator 122 provided in the first sub liquid chamber 121 is operated in a direction to decrease the volume of the first sub liquid chamber 121, the quantity of flow corresponding to A1 is temporarily stored in the first sub liquid chamber 121, and the adjustment for preventing the ink from flowing to the main liquid chamber 111 at once is performed, and in this way, the ink flows in such a manner that the quantity of flow corresponding to A1 shown in FIG. 5 is diverted by A2, thereby stabilizing the quantity of flow of the ink flowing from the suction section 123. In other words, the first sub actuator 122 provided in the first sub liquid chamber 121 is operated so that the quantity of flow changes as shown in FIG. 7. In this operation, the second sub actuator 132 operates in the direction to decrease the volume of the second sub liquid chamber 131, and the flow of the ink to the discharge section 133 does not stop, so that the quantity of flow of the ink corresponding to B1 stored in the second sub liquid chamber 131 in advance is diverted by B2 shown in FIG. 6, thereby stabilizing the quantity of flow of the ink discharged from the discharge section 133.

As shown in FIG. 4, in the diaphragm pump 100 when the main pump 101 discharges the ink from the discharge section 133, the main actuator 112 contracts to decrease the volume of the main liquid chamber 111. When the volume of the main liquid chamber 111 is decreased, the internal pressure of the main liquid chamber 111 increases and the ink flows to the second sub liquid chamber 131 at once, and thus, the volume of the second sub liquid chamber 131 is expanded (the volume is increased) by the second sub actuator 132 provided in the second sub liquid chamber 131. As a result, in the diaphragm pump 100, the ink of which the quantity of flow corresponds to B1 is stored in the second sub liquid chamber 131 in such a manner that the ink does not flow out to the discharge section 133 at once, and the ink of which the quantity of flow corresponds to B1 is diverted by B2 shown in FIG. 6, thereby stabilizing the quantity of flow of the ink discharged from the discharge section 133.

At this time, the first sub actuator 122 provided in the first sub liquid chamber 121 is operated in a direction to expand the volume of the first sub liquid chamber 121 (the volume is increased), and the ink flows in such a manner that the quantity of flow corresponding to A1 is diverted by A2 shown in FIG. 5 so that the flow from the suction section 123 does not stop, thereby stabilizing the quantity of flow of the ink sucked from the suction section 123.

As described above, the diaphragm pump 100 performs adjustment using the first sub pump 105 and the second sub pump 106 to stabilize the quantity of flow of the ink sucked from the suction section 123 and the quantity of flow of the ink discharged from the discharge section 133. As a result, as shown in FIG. 9, the average quantity of flow becomes constant, and the pulsation of the ink flowing through the diaphragm pump 100 is reduced.

As described above, with respect to a volume change amount due to the driving of the main actuator 112, a volume change amount due to the driving of the first sub actuator 122 provided in the first sub liquid chamber 121, and a volume change amount due to the driving of the second sub actuator 132 provided in the second sub liquid chamber 131, the actuators 112, 122 and 132 are adjusted in advance to stabilize the quantity of flow of the ink.

For example, an example of adjustment when the adjustment is necessary for the operation of the first sub actuator 122 provided in the first sub liquid chamber (suction chamber) 121 and the operation of the second sub actuator 132 provided in the second sub liquid chamber (liquid feed chamber) 131 is shown below.

For example, when the pressure on an inlet (the suction section 123) side of the diaphragm pump 100 is higher than a reference pressure, the controller 103 determines that the quantity of inflow is small, i.e., the ink hardly flows to each of the liquid chambers 111, 121 and 131 of the diaphragm pump 100. As a result, the controller 103 performs adjustment by shifting the phase by bringing forward a timing at which the first sub actuator 122 of the first sub liquid chamber 121 is expanded. When the pressure on the inlet side of the diaphragm pump 100 is lower than the reference pressure, the controller 103 determines that the quantity of inflow is large, i.e., the ink excessively flows to each of the liquid chambers 111, 121 and 131 of the diaphragm pump 100. As a result, the controller 103 performs adjustment by shifting the phase by bringing forward a timing at which the first sub actuator 122 of the first sub liquid chamber 121 is contacted.

Likewise, when the pressure on an outlet (discharge section 133) side of the diaphragm pump 100 is higher than the reference pressure, the controller 103 determines that the quantity of outflow is large, i.e., the ink is excessively discharged from the main pump 101. As a result, the controller 103 performs adjustment by shifting the phase by bringing forward a timing at which the second sub actuator 132 of the second sub liquid chamber 131 is expanded. Likewise, when the pressure on the outlet side of the diaphragm pump 100 is lower than the reference pressure, the controller 103 determines that the quantity of outflow is small, i.e., the ink is hardly discharged from the main pump 101. As a result, the controller 103 performs adjustment by shifting the phase by bringing forward a timing at which the second sub actuator 132 of the second sub liquid chamber 131 is contacted.

As described above, according to the diaphragm pump 100 according to the present embodiment, the pulsation can be reduced.

(Inkjet Recording Apparatus 1)

Figure 10:
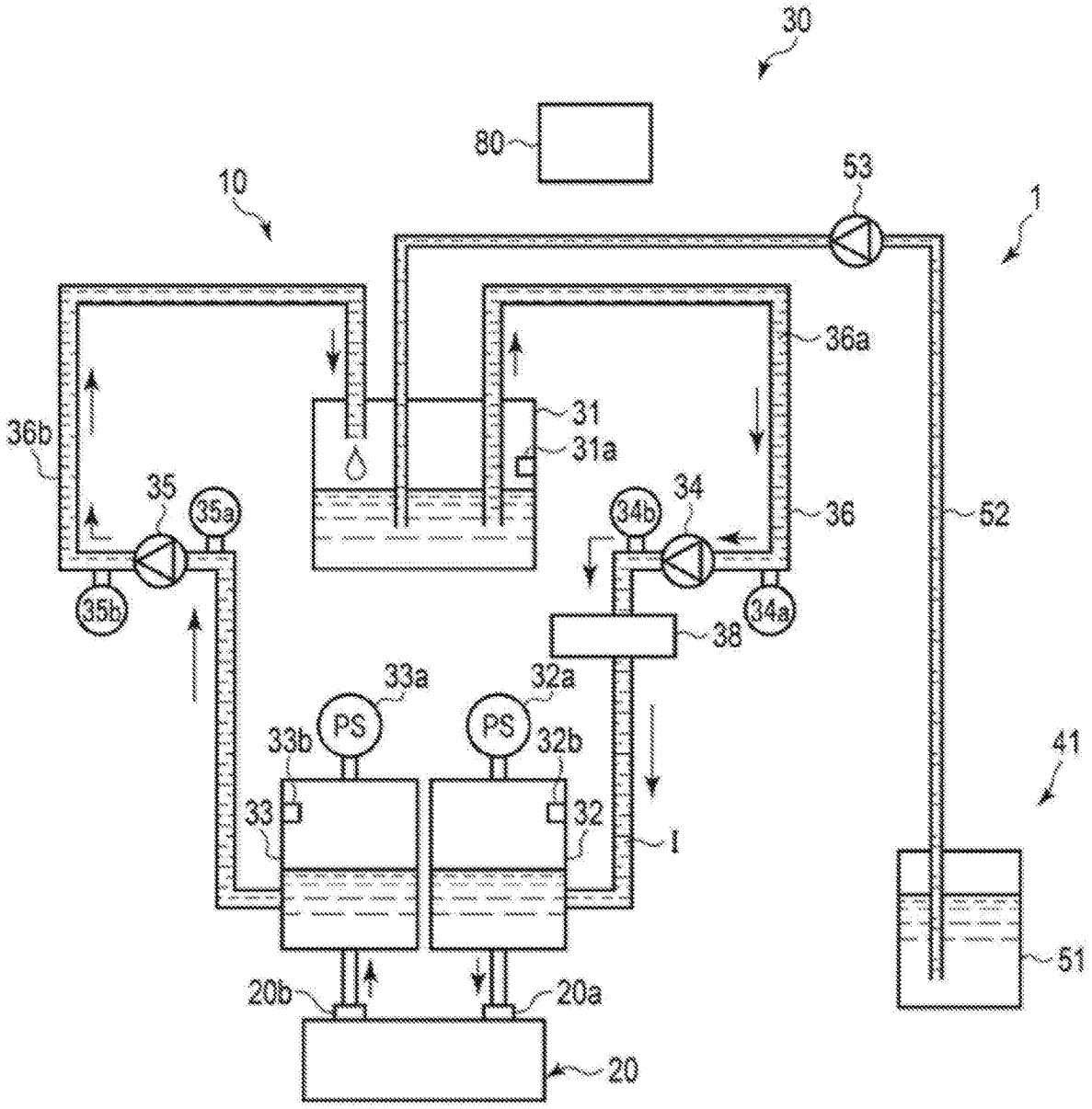
FIG. 10 is a diagram illustrating a configuration of a liquid circulation module of an inkjet recording apparatus according to the embodiment.
Figure 11:
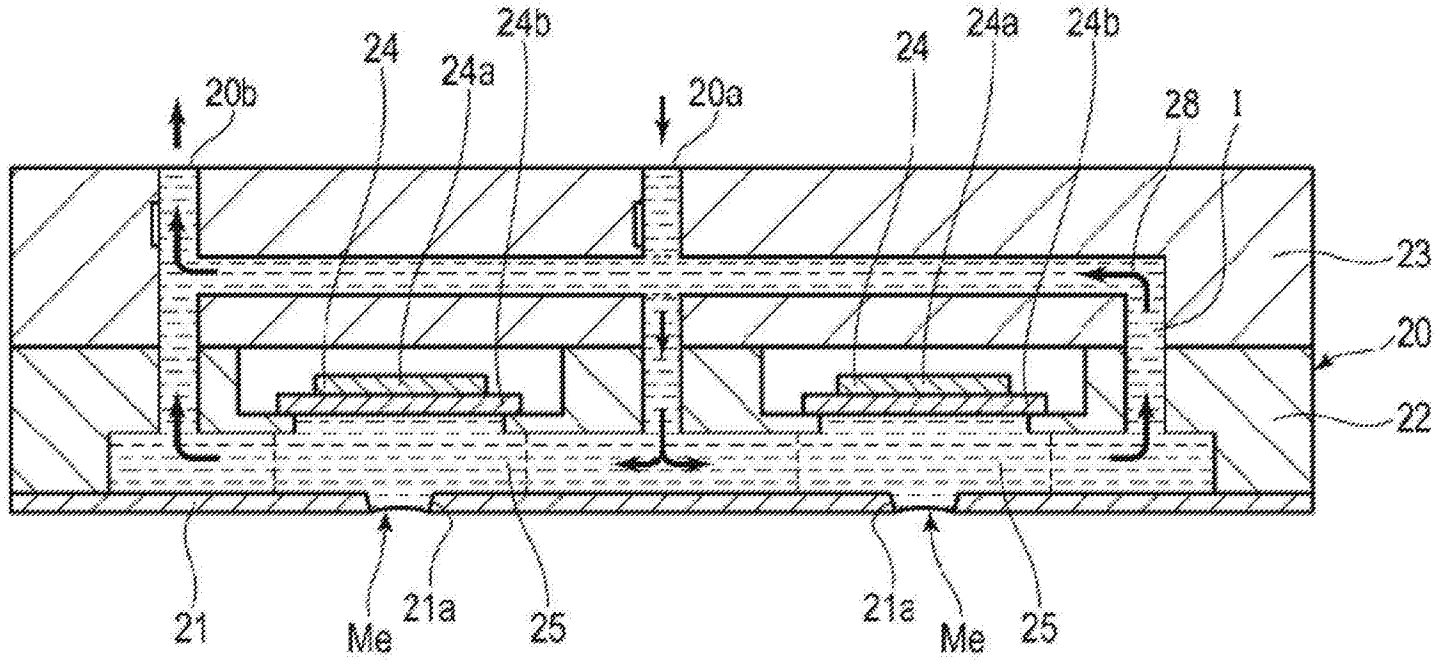
FIG. 11 is a cross-sectional view illustrating a configuration of a liquid discharge head of the inkjet recording apparatus.
Figure 12:
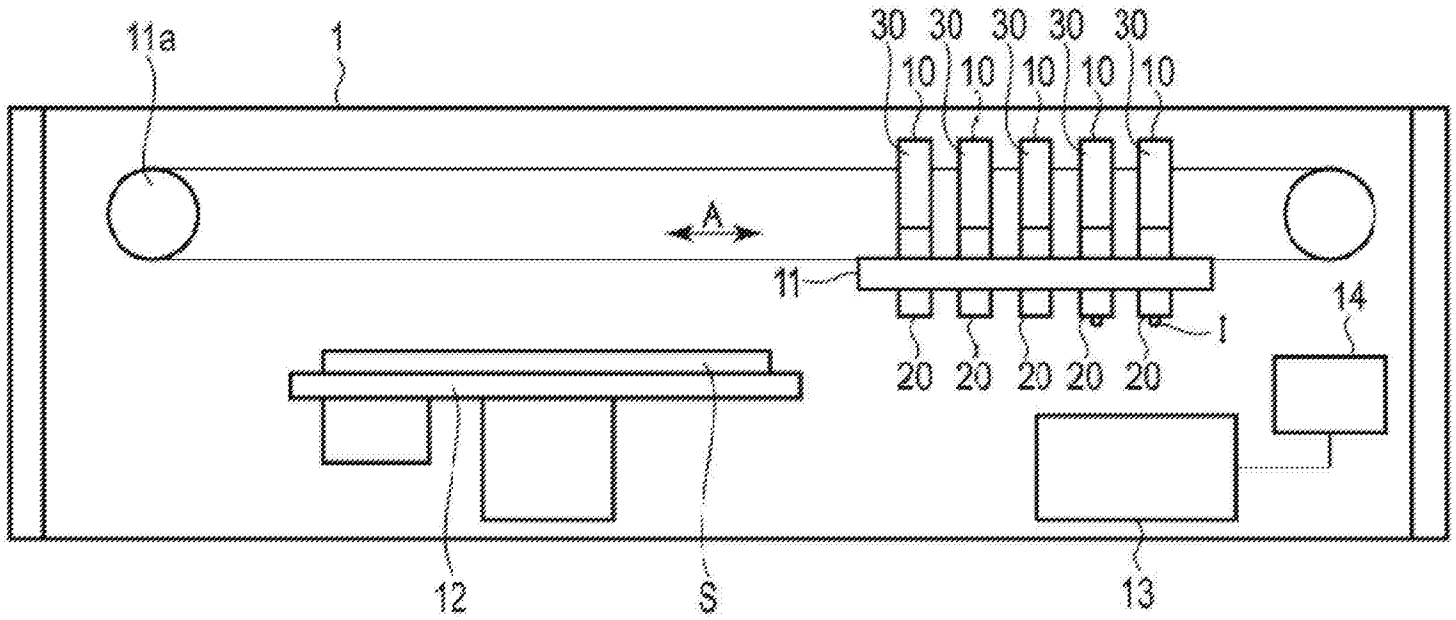
FIG. 12 is a side view illustrating a configuration of the inkjet recording apparatus.
Figure 13:
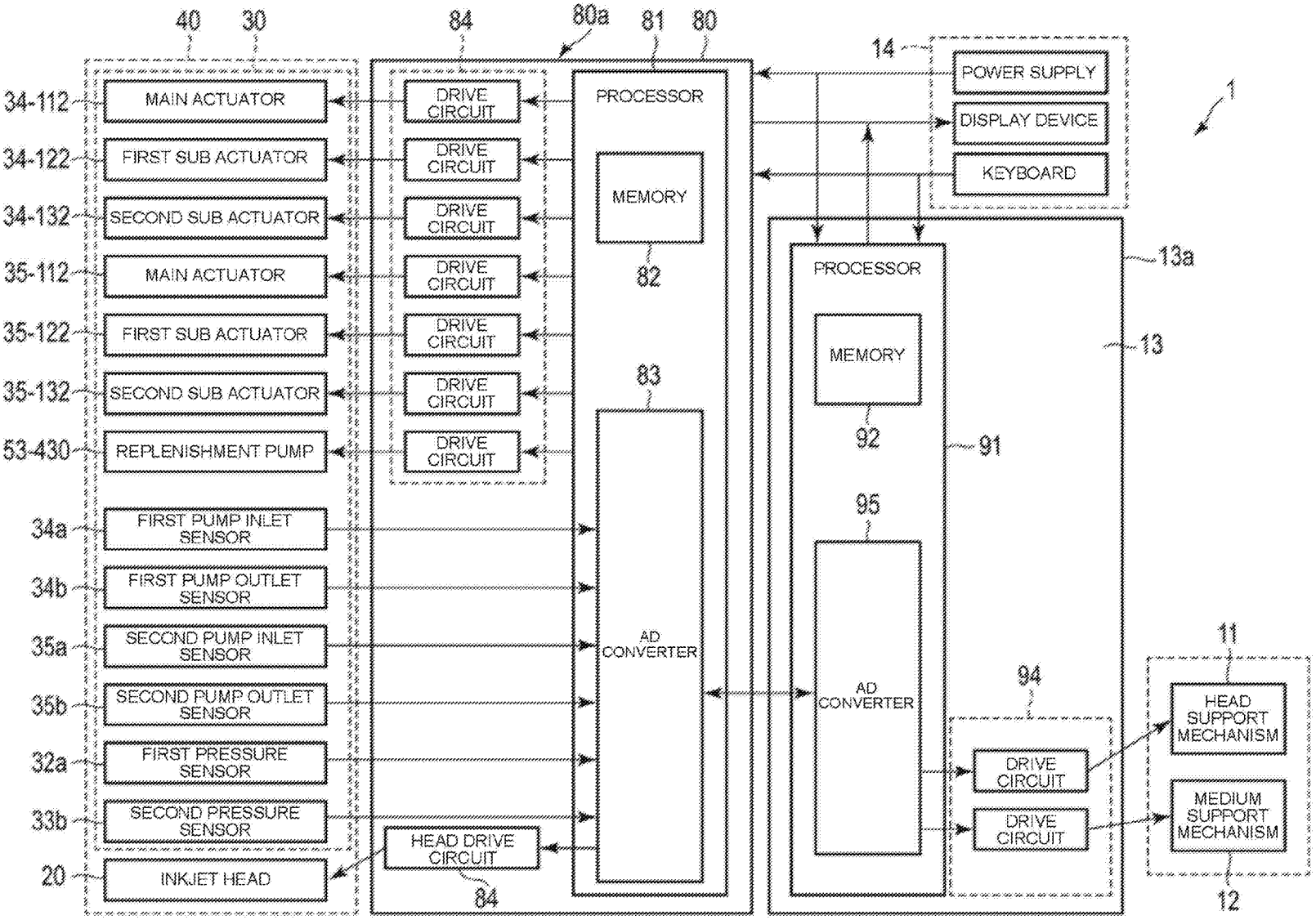
FIG. 13 is a block diagram illustrating a configuration of the inkjet recording apparatus.

Next, the inkjet recording apparatus 1 including such a diaphragm pump 100 is described with reference to FIG. 10 to FIG. 14. FIG. 10 is a diagram illustrating a configuration of a liquid circulation module 10. FIG. 11 is a diagram illustrating a configuration of a liquid discharge head. FIG. 12 is a side view illustrating the configuration of the inkjet recording apparatus 1. FIG. 13 is a block diagram illustrating a module controller 80. For convenience of description, the configuration is appropriately enlarged, reduced or omitted in each figure.

As shown in FIG. 10 to FIG. 13, the inkjet recording apparatus 1 which is an example of the liquid discharge apparatus includes a plurality of the liquid circulation modules 10, a head support mechanism 11, a medium support mechanism 12, a host controller 13, and an interface section 14.

A plurality of the liquid circulation modules 10 is arranged side by side in one direction, and is supported by the head support mechanism 11. The number of the liquid circulation modules 10 is the same as the number of types of ink I used in the inkjet recording apparatus 1.

The liquid circulation module 10 includes a liquid discharge head 20 and a circulation device 30 in an integral manner. The liquid circulation module 10 comprises the module controller 80. The liquid circulation module 10 forms a desired image on an image receiving medium S facing the liquid circulation module 10 by discharging the ink I as the liquid from the liquid discharge head 20.

A plurality of the liquid circulation modules 10 discharges ink of a plurality of colors, such as cyan ink, magenta ink, yellow ink, black ink, and white ink, respectively; however, the color or characteristic of the ink I to be used is not limited. For example, instead of the white ink, transparent glossy ink, special ink that develops color when irradiated with infrared rays or ultraviolet rays, or the like may be discharged. The plurality of the liquid circulation modules 10 has the same configuration although the ink I to be used by the liquid circulation modules 10 is different.

The liquid discharge head 20 shown in FIG. 11 is an inkjet head, and includes a nozzle plate 21, a substrate 22, and a manifold 23 bonded to the substrate 22.

The nozzle plate 21 is formed in a rectangular shape. The nozzle plate 21 has a plurality of nozzle holes 21*a*.

The substrate 22 is formed into a rectangular shape, and is bonded to the nozzle plate 21 to face the nozzle plate 21. The substrate 22 forms a predetermined ink flow path 28 on which a plurality of pressure chambers 25 is provided between the substrate 22 and the nozzle plate 21. The substrate 22 has partition walls for partitioning the adjacent pressure chambers 25. An actuator 24 is provided in a portion facing each pressure chamber 25.

The actuator 24 is, for example, constituted by a unimorph type piezoelectric vibration plate in which a piezoelectric element 24*a* and a vibration plate 24*b* are laminated. The piezoelectric element 24*a* is made of a piezoelectric ceramic material such as PZT or the like. The vibration plate 24*b* is made of, for example, SiN (silicon nitride) or the like. The piezoelectric element 24*a* has electrodes on the upper and lower sides thereof.

The manifold 23 is formed into a rectangular shape and is bonded to an upper part of the substrate 22. The manifold 23 has a supply port 20*a* and a collection port 20*b* which communicate with the circulation device 30, and forms the predetermined ink flow path 28.

In such a liquid discharge head 20, a plurality of the pressure chambers 25 partitioned by partition walls is formed in a state in which the nozzle plate 21, the substrate 22 and the manifold 23 are assembled, and the ink flow path 28 connecting each of the pressure chambers 25 is formed.

As shown in FIG. 10, the circulation device 30 is integrally connected to the upper part of the liquid discharge head 20 by, for example, a metal connection component. The circulation device 30 comprises a first tank 31, a second tank 32, a third tank 33, a first pump 34, a second pump 35, a circulation path 36, a filter 38 and a replenishment section 41.

The first tank 31 is located at the primary side of the second tank 32 and at the secondary side of the third tank 33. The first tank 31 can store the ink I. The first tank 31 has a first liquid level sensor 31*a* for detecting a height of liquid surface in the first tank 31.

The second tank 32 is arranged between the first tank 31 and the liquid discharge head 20 to be capable of storing the liquid. The second tank 32 is provided with a first pressure sensor 32*a* which is a first pressure detection section. The second tank 32 has a second liquid level sensor 32*b* for detecting the height of the liquid surface of the second tank 32.

The third tank 33 is located on the downstream side of the liquid discharge head 20 to be capable of storing the liquid. The third tank 33 is provided with a second pressure sensor 33*a* which is a second pressure detection section. The third tank 33 has a third liquid level sensor 33*b* for detecting the height of the liquid surface of the third tank 33.

The first pump 34 and the second pump 35 are the above-described diaphragm pump 100.

The first pump 34 includes a first inlet sensor 34*a* provided on the inlet (suction section 123) side, and a first outlet sensor 34*b* provided on the outlet (discharge section 133) side.

The second pump 35 includes a second inlet sensor 35*a* provided on the inlet side and a second outlet sensor 35*b* provided on the outlet side.

The first pressure sensor 32*a* and the second pressure sensor 33*a*, the first inlet sensor 34*a* and the first outlet sensor 34*b* of the first pump 34, and the second inlet sensor 35*a* and the second outlet sensor 35*b* are, for example, semiconductor piezoresistance pressure sensors which output pressure as an electric signal. The semiconductor piezoresistance pressure sensor comprises a diaphragm which receives pressure from the outside, and a semiconductor strain gauge formed on the surface of the diaphragm. The semiconductor piezoresistance pressure sensor detects the pressure by converting a change in an electrical resistance caused by a piezoresistance effect occurring in the strain gauge due to the deformation of the diaphragm caused by the pressure from the outside to an electric signal.

The first pressure sensor 32*a* detects the pressure in an air chamber in the second tank 32 and sends the detection data to the module controller 80. The second pressure sensor 33*a* detects the pressure in the air chamber in the third tank 33 and sends the detection data to the module controller 80.

The circulation path 36 comprises a supply flow path 36*a* and a collection flow path 36*b*. The circulation path 36 is a path from the first tank 31 through the supply flow path 36*a* to the supply port 20*a* of the liquid discharge head 20, and from the collection port 20*b* of the liquid discharge head 20 through the collection flow path 36*b* to the first tank 31.

The supply flow path 36*a* is a flow path from the first tank 31 to the supply port 20*a* of the liquid discharge head 20. In the supply flow path 36*a*, the first pump 34 which is a circulation pump, the filter 38 and the second tank 32 are provided in order.

The collection flow path 36*b* is a flow path from the collection port 20*b* of the liquid discharge head 20 to the first tank 31. In the collection flow path 36*b*, the third tank 33 and the second pump 35 which is the circulation pump are provided.

The first inlet sensor 34*a* and the first outlet sensor 34*b* detect the pressure of the fluid on the inlet side and the outlet side of the first pump 34 provided in the supply flow path 36*a*, respectively, and send the detection data to the module controller 80.

The second inlet sensor 35*a* and the second outlet sensor 35*b* detect the pressure of the fluid on the inlet side and the outlet side of the second pump 35 provided in the collection flow path 36*b*, respectively, and send the detection data to the module controller 80.

The supply flow path 36*a* and the collection flow path 36*b* each comprise a pipe made of metal or resin material, and a tube covering an outer surface of the pipe such as a PTFE tube.

The first pump 34 is provided in the supply flow path 36*a* of the circulation path 36. The first pump 34 is arranged between the first tank 31 and the liquid discharge head 20 and on the upstream side of the second tank 32. The first pump 34 feeds the liquid in the circulation path 36 towards the liquid discharge head 20 located on the downstream side thereof.

The second pump 35 is provided in the collection flow path 36*b* of the circulation path 36. The second pump 35 is arranged between the liquid discharge head 20 and the first tank 31 and on the downstream side of the third tank 33. The second pump 35 feeds the liquid in the circulation path 36 towards the first tank 31 arranged on the downstream side thereof.

The filter 38 includes a filter casing and a filter arranged in the filter casing. The filter casing is formed into a box shape having an inflow port and an outflow port. The filter may be a polypropylene filter, a nylon filter, a PVDF filter, a PTFE filter, a polycarbonate filter, a nickel electroformed filter, a stainless steel filter, or the like which has an average hole size of about several μm.

The replenishment section 41 includes a cartridge 51 as a replenishment tank provided at the outside of the circulation path 36, a replenishment path 52 and a replenishment pump 53. The cartridge 51 can store the ink to be supplied to the first tank 31, and an internal air chamber thereof is open to the atmosphere. The replenishment path 52 is a flow path connecting the first tank 31 with the cartridge 51.

The replenishment pump 53 is provided in the replenishment path 52 to feed the ink in the cartridge 51 to the first tank 31. The replenishment pump 53 is provided in the replenishment path 52. The replenishment pump 53 feeds the ink I stored in the cartridge 51 towards the first tank 31. The replenishment pump 53 is, for example, the diaphragm pump 100. The replenishment pump 53 may also be a general piezoelectric pump, a motor type diaphragm pump, or the like.

As shown in FIG. 13, on a control board 80*a* mounted on the liquid circulation module 10, the module controller 80 includes a processor 81 for controlling the operation of each section, and a drive circuit 84 for driving each element.

The module controller 80 is connected to the interface section 14 including a power supply, a display device and an input device. The module controller 80 is connected to the host controller 13 to be capable of communicating with the host controller 13.

For example, the control board 80*a* is formed into a rectangular shape, and is arranged on the side surface of the circulation device 30 on the liquid discharge head 20.

The processor 81 includes a memory 82 for storing programs and various kinds of data, and an AD converter 83 for converting analog data (voltage value) to digital data (bit data).

The processor 81 acts as a central part of the module controller 80. The processor 81 controls each section of the liquid circulation module 10 to realize various functions of the liquid circulation module 10 by executing an operating system and application programs.

The processor 81 is connected to a drive section of various pumps and various sensors of the liquid circulation module 10 to control the liquid circulation module 10.

The processor 81 executes a control processing by executing a control program previously recorded in the memory 82 or instructed from the host controller 13, the module controller 80 functions as a circulation module, a replenishment module, a pressure adjustment module and a pipeline adjustment module. The processor 81 functions as the controller 103 of the diaphragm pump 100.

For example, the processor 81 functions as the circulation module for circulating the ink by controlling the operations of the first pump 34 and the second pump 35.

The processor 81 controls the operation of the main actuator 112 of the replenishment pump 53 based on the information detected by the first liquid level sensor 31*a* and the pressure sensors 32*a* and 33*a* to function as the replenishment module for replenishing the ink from the cartridge 51 to the circulation path 36.

The processor 81 acquires the information detected by the first pressure sensor 32*a*, the second pressure sensor 33*a*, and the liquid level sensor 31*a* using the AD converter 83.

The memory 82 is, for example, a nonvolatile memory, and stores various control programs and operation conditions as information necessary for controlling the circulation operation of the ink I, the replenishment operation of the ink, the pressure adjustment, the liquid level management, etc.

Furthermore, the processor 81 controls liquid feed capability of the first pump 34 and the second pump 35 based on the information detected by the first liquid level sensor 31*a* and the pressure sensors 32*a* and 33*a* to function as the pressure adjustment module for adjusting the ink pressure in the nozzle hole 21*a*. The liquid feed capability of the first pump 34 and the second pump 35 is controlled by controlling the driving of the main actuator 112 (34-112) of the first pump 34 and the main actuator 112 (35-112) of the second pump 35.

Based on the information detected by the first inlet sensor 34*a* and the first outlet sensor 34*b* of the first pump 34, the processor 81 controls the first sub actuator 122 (34-122) of the first pump 34 and the second sub actuator 132 (34-132) of the first pump 34 to reduce the pulsation of the first pump 34.

Based on the information detected by the second inlet sensor 35*a* and the second outlet sensor 35*b*, the processor 81 controls the first sub actuator 122 (35-122) of the second pump 35 and the second sub actuator 132 (35-132) of the second pump 35 to reduce the pulsation of the second pump 35.

The head support mechanism 11 supports the plurality of the liquid circulation modules 10 in such a manner that the liquid discharge heads 20 face the medium support mechanism 12. The head support mechanism 11 includes a carriage 11*a* that relatively moves the supported plural liquid circulation modules 10 to positions facing the medium support mechanism 12.

The medium support mechanism 12 is a moving device that supports and moves the image receiving medium S such as a sheet on which the ink discharged from the liquid discharge head 20 is applied.

The host controller 13 is connected to the module controller 80 to be capable of communicating with the module controller 80. The host controller 13 includes a processor 91 provided on the control board and a drive circuit 94 for driving the head support mechanism 11 and the medium support mechanism 12. The host controller 13 includes an AD converter 95 connected to the AD converter 83 of the module controller 80.

The processor 91 includes a memory 92 for storing programs and various kinds of data, and the AD converter 95 for converting analog data (voltage value) to digital data (bit data).

The processor 91 acts as a central part of the host controller 13. The processor 91 controls each section of the inkjet recording apparatus 1 to realize various functions of the inkjet recording apparatus 1 by executing an operating system and application programs. For example, the processor of the host controller 13 conveys the carriage 11*a* provided in the head support mechanism 11 towards the image receiving medium S and reciprocates in the direction indicated by an arrow A.

The interface section 14 electrically connects the host controller 13 and the module controller 80 to a power supply, a display device and a keyboard thereof.

Next, a liquid discharge method in the liquid circulation module 10 and a control method of the liquid circulation module 10 according to the present embodiment are described.

The processor 81 of the module controller 80 starts a printing operation if an instruction to start circulation input through the interface section 14 is detected. In the printing operation, the host controller 13 controls the liquid circulation module 10 to reciprocate in a direction orthogonal to a conveyance direction of the image receiving medium S, and the module controller 80 controls the liquid discharge head 20 to discharge the ink, thereby forming an image on the image receiving medium S.

The processor 91 of the host controller 13 controls each section of the inkjet recording apparatus 1 to realize various functions of the inkjet recording apparatus 1 by executing the operating system and the application programs. For example, the processor 91 of the host controller 13 conveys the carriage 11*a* provided in the head support mechanism 11 towards the image receiving medium S and reciprocates the carriage 11*a* in the direction indicated by the arrow A.

The processor 81 of the module controller 80 transmits an image signal corresponding to image data to the drive circuit 84 of the liquid discharge head 20 and selectively drives the actuator 24 of the liquid discharge head 20 to discharge the ink droplets from the nozzle hole 21*a* to the image receiving medium S.

Then, the processor 81 drives the first pump 34 and the second pump 35 to start an ink circulation operation. When the ink circulation operation is started, the ink I circulates from the first tank 31 to the second tank 32 and the liquid discharge head 20, and then again to the first tank 31 via the third tank 33. By the circulation operation, impurities contained in the ink I are removed by the filter 38 provided in the circulation path 36.

At this time, the processor 81 performs the following adjustment to suppress pulsation of the ink occurring due to the driving of the main pump 101. The same adjustment on the first pump 34 and the second pump 35 is performed by the processor 81 according to an adjustment method previously stored in the memory 82.

The first inlet sensor 34*a* and the first outlet sensor 34*b* detect the pressure of the fluid on the inlet side and the outlet side of the first pump 34 provided in the supply flow path 36*a*, respectively, and send the detection data to the module controller 80.

The second inlet sensor 35*a* and the second outlet sensor 35*b* detect the pressure of the fluid on the inlet side and the outlet side of the second pump 35 provided in the collection flow path 36*b*, respectively, and send the detection data to the module controller 80. When the pressure on the inlet side of the first pump 34 (the pressure value detected by the first inlet sensor 34*a*) is higher than the reference pressure, the processor 81 determines that the quantity of flow of the ink flowing to the liquid chambers 111, 121 and 131 of the first pump 34 decreases, and performs adjustment by shifting the phase by bringing forward the timing at which the first sub actuator 122 of the first sub liquid chamber 121 expands.

When the pressure on the inlet side of the first pump (the pressure value detected by the first inlet sensor 34*a*) is lower than the reference pressure, the processor 81 determines that the quantity of flow of the ink flowing to the liquid chambers 111, 121 and 131 of the first pump 34 increases, and performs adjustment by shifting the phase by bringing forward the timing at which the first sub actuator 122 of the first sub liquid chamber 121 contracts.

Similarly, when the pressure on the outlet side of the first pump 34 (the pressure value detected by the first outlet sensor 34*b*) is higher than the reference pressure, the processor 81 determines that the quantity of flow of the ink fed from the main pump 101 increases, and performs adjustment by shifting the phase by bringing forward the timing at which the second sub actuator 132 of the second sub liquid chamber 131 expands. When the pressure on the outlet side of the first pump 34 (the pressure value detected by the first outlet sensor 34*b*) is lower than the reference pressure, the processor 81 determines that the quantity of flow of the ink fed from the main pump 101 decreases, and performs adjustment by shifting the phase by bringing forward the timing at which the second sub actuator 132 of the second sub liquid chamber 131 contacts. The processor 81 performs the same adjustment on the second pump 35.

The processor 81 detects pressure data on the upstream side and the downstream side respectively transmitted from the first pressure sensor 32*a* and the second pressure sensor 33*a*. The processor 81 detects a liquid level of the first tank 31 based on the data transmitted from the first liquid level sensor 31*a*.

The processor 81 performs a liquid level adjustment processing. Specifically, the processor 81 drives the replenishment pump 53 based on a detection result of the first liquid level sensor 31*a* to replenish the ink from the cartridge 51 and to adjust a position of the liquid surface to an appropriate range. For example, at the time of printing, when the ink I is discharged from the nozzle hole 21*a*, the ink amount in the first tank 31 instantaneously decreases, and the liquid surface falls, the ink is replenished. When the ink amount increases again and the output result of the first liquid level sensor 31*a* is reverse to the above result, the processor 81 stops the replenishment pump 53.

The processor 81 detects the ink pressure of the nozzle from the pressure data. Specifically, based on the pressure data of the second tank 32 and the third tank 33 on the upstream side and the downstream side transmitted from the pressure sensors 32*a* and 33*a*, the ink pressure in the nozzle hole 21*a* is calculated using a predetermined arithmetic expression.

For example, an average value of a pressure value Ph of the air chamber of the second tank 32 and a pressure value P1 of the air chamber of the third tank 33 is added to the pressure ρgh generated due to water head difference between the height of the liquid surfaces in the second tank 32 and the third tank 33 and the height of the nozzle surface to obtain the ink pressure Pn of the nozzle. Here, ρ is an ink density, g is a gravitational acceleration, and h is a distance between the liquid surfaces in the second tank 32 and the third tank 33 and the height of the nozzle surface.

The processor 81 calculates a drive voltage as a pressure adjustment processing based on the ink pressure Pn of the nozzle calculated from the pressure data. Then, the processor 81 drives the first pump 34 and the second pump 35 so that the ink pressure Pn of the nozzle becomes an appropriate value, and in this way, the ink I does not leak from the nozzle hole 21*a* of the liquid discharge head 20, and a negative pressure at which bubbles are not sucked from the nozzle hole is maintained, and a meniscus Me is maintained.

As a result, the liquid circulation module 10 is controlled and the ink is discharged from the nozzle.

According to the inkjet recording apparatus 1 configured as described above, the pulsation in the liquid circulation module 10 can be reduced by using the diaphragm pump 100 as the first pump 34 and the second pump 35. Therefore, due to the pulsation, it is possible to prevent the discharge of the unnecessary ink I from the nozzle hole 21*a* of the liquid discharge head 20, and to prevent suction of the excessive ink I from the nozzle hole 21*a* and suction of air bubbles. Specifically, since an appropriate meniscus Me can be maintained in the nozzle hole 21*a*, the printing accuracy of the inkjet recording apparatus 1 is improved.

As described above, according to the inkjet recording apparatus 1 of the present embodiment, the pulsation in the liquid circulation module 10 can be reduced.

The present invention is not limited to the above embodiment without any change, and it may be embodied by modifying components without departing from the spirit thereof in an implementation stage.

In the above-described example, the diaphragm pump 100 and the inkjet recording apparatus 1 discharge the ink I, but they are not limited thereto. For example, the diaphragm pump 100 may be used in the liquid discharge apparatus for discharging the liquid other than the ink I, and for example, it may be used in an apparatus for discharging liquid containing conductive particles for forming a wiring pattern on a printing wiring substrate. The diaphragm pump 100 may also be used, for example, in a 3D (three-dimensional) printer, industrial manufacturing machine, medical application or the like, and can be reduced in the size, the weight, and the cost.

In addition to the above-mentioned example, the liquid discharge head 20 described above may discharge ink droplets by deforming the vibration plate with static electricity, or may discharge ink droplets from the nozzle using thermal energy of a heater or the like.

The replenishment pump 53 may be, for example, a tube pump, a diaphragm pump, a piston pump or the like in place of the piezoelectric pump.

Furthermore, in the above-described example, the diaphragm pump 100 uses the first sub pump 105 and the second sub pump 106 as the sub pumps 102 on the primary side and the secondary side of the main pump 101, but it is not limited thereto. For example, as shown in FIG. 14 and FIG. 15, in the diaphragm pump 100, the sub pump 102 may be provided only in either the primary side or the secondary side of the main pump 101.

Figure 14:
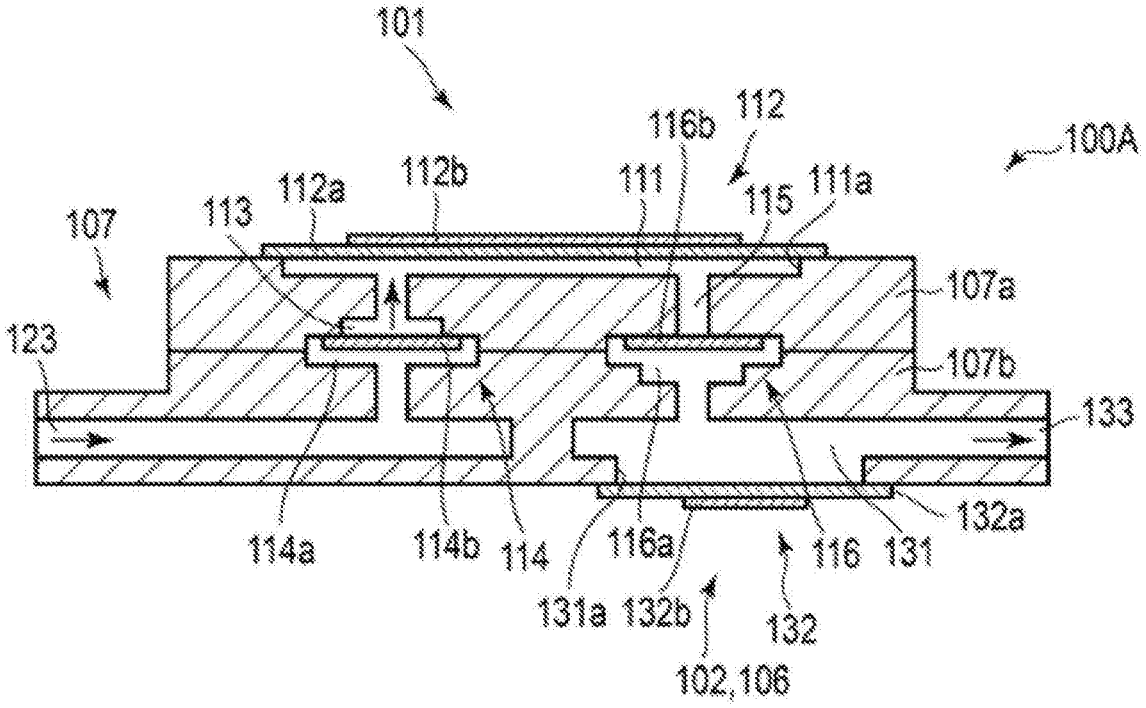
FIG. 14 is a cross-sectional view illustrating a configuration of a diaphragm pump according to another embodiment.

Specifically, as shown in FIG. 14, in a diaphragm pump 100A, the second sub pump 106 is provided on the secondary side of the main pump 101, and only the suction section 123 is provided on the primary side of the main pump 101. With such a configuration, the pulsation of the ink discharged from the discharge section 133 can be reduced.

Figure 15:
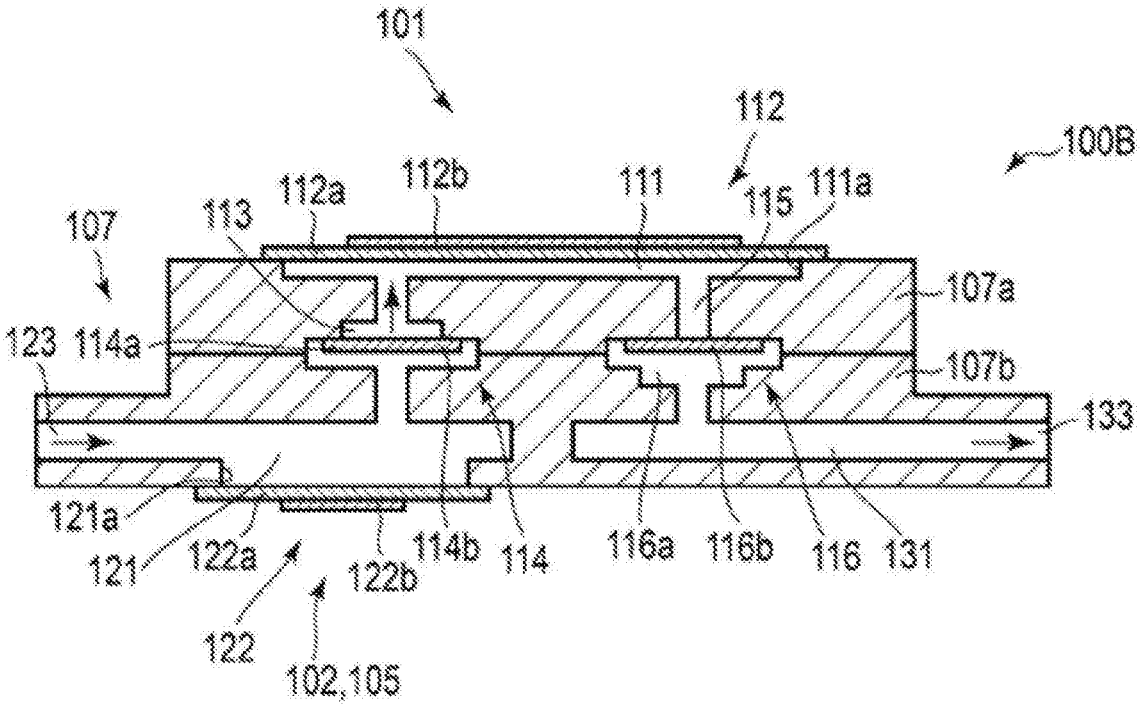
FIG. 15 is a cross-sectional view illustrating a configuration of a diaphragm pump according to still another embodiment.

As shown in FIG. 15, in a diaphragm pump 100B, the first sub pump 105 is provided on the primary side of the main pump 101, and only the discharge section 133 is provided on the secondary side of the main pump 101. With such a configuration, the pulsation of the ink flowing in from the suction section 123 can be reduced.

For this reason, for example, when the diaphragm pumps 100A and 100B are applied to the liquid circulation module 10, by using the diaphragm pump 100A as the first pump 34 provided on the primary side of the second tank 32, the pulsation of the ink supplied to the liquid discharge head 20 can be reduced. Therefore, it is possible to prevent the ink from leaking from the nozzle hole 21*a*.

By using the diaphragm pump 100B as the second pump 35 provided on the secondary side of the third tank 33, it is possible to reduce the pulsation of the ink flowing from the liquid discharge head 20 to the diaphragm pump 100. Therefore, the suction of the excessive ink from the nozzle hole 21*a* and the suction of air can be prevented.

Furthermore, in the example described above, the configuration in which the main pump 101, the first sub pump 105 and the second sub pump 106 are provided has been described, but in addition to the configuration, an amount of change in the volumes of the first sub liquid chamber 121 and the second sub liquid chamber 122 may be set to the half of an amount of change in the volume of the main liquid chamber 111. A driving period of the first sub actuator 122 and the second sub actuator 132 may be an integral multiple or a fraction of a driving period of the main actuator 112. Specifically, in the diaphragm pump 100, the shape, arrangement and control of the main pump 101 and the sub pump 102 may be appropriately set.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A diaphragm pump, comprising:
a main liquid chamber;
a main actuator configured to change a volume of the main liquid chamber;
a sub liquid chamber configured to communicate with a primary side or a secondary side of the main liquid chamber;
a sub actuator configured to change a volume of the sub liquid chamber;
a first check valve provided on the primary side of the main liquid chamber;
a second check valve provided on the secondary side of the main liquid chamber; and
a controller configured to control the main actuator and the sub actuator.

2. The diaphragm pump according to claim 1, wherein
the sub liquid chamber and the sub actuator are respectively provided on the primary side and the secondary side of the main actuator.

3. The diaphragm pump according to claim 1, wherein
the main actuator and the sub actuator individually comprise piezoelectric members.

4. The diaphragm pump according to claim 2, wherein
the main actuator and the sub actuator individually comprise piezoelectric members.

5. The diaphragm pump according to claim 1, wherein
the controller controls an operation of the sub actuator to decrease a volume of the sub liquid chamber when the main actuator performs an operation of increasing the volume of the main liquid chamber, and controls an operation of the sub actuator to increase a volume of the sub liquid chamber when the main actuator performs an operation of decreasing the volume of the main liquid chamber.

6. The diaphragm pump according to claim 3, wherein
the piezoelectric members comprise lead zirconate titanate, lead titanate, PMNT (Pb $(Mg_{1/3}Nb_{2/3})O_3$—$PbTiO_3$), PZNT (Pb $(Zn_{1/3}Nb_{2/3})O_3$—$PbTiO_3$), ZnO, or AlN.

7. The diaphragm pump according to claim 1, wherein
the sub actuator comprises a first sub actuator and a second sub actuator, and the controller is further configured to drive the first sub actuator and the second sub actuator in different phases.

8. A liquid circulation module, comprising:
an ink tank;
an inkjet head connected to the ink tank on a primary side and a secondary side thereof; and
a diagram pump provided at least either between the secondary side of the ink tank and a primary side of the inkjet head or between the primary side of the ink tank and a secondary side of the inkjet head, wherein
the diagram pump comprising:
a main liquid chamber;
a main actuator configured to change a volume of the main liquid chamber;
a sub liquid chamber configured to communicate with a primary side or a secondary side of the main liquid chamber;
a sub actuator configured to change a volume of the sub liquid chamber;
a first check valve provided on the primary side of the main liquid chamber;
a second check valve provided on the secondary side of the main liquid chamber; and
a controller configured to control the main actuator and the sub actuator.

9. The liquid circulation module according to claim 8, wherein
the sub liquid chamber and the sub actuator are respectively provided on the primary side and the secondary side of the main actuator.

10. The liquid circulation module according to claim 8, wherein
the main actuator and the sub actuator individually comprise piezoelectric members.

11. The liquid circulation module according to claim 9, wherein
the main actuator and the sub actuator individually comprise piezoelectric members.

12. The liquid circulation module according to claim 8, wherein the controller controls an operation of the sub actuator to decrease a volume of the sub liquid chamber when the main actuator performs an operation of increasing the volume of the main liquid chamber, and controls an operation of the sub actuator to increase a volume of the sub liquid chamber when the main actuator performs an operation of decreasing the volume of the main liquid chamber.

13. The liquid circulation module according to claim 10, wherein the piezoelectric members comprise lead zirconate titanate, lead titanate, PMNT (Pb $(Mg_{1/3}Nb_{2/3})O_3$—$PbTiO_3$), PZNT (Pb $(Zn_{1/3}Nb_{2/3})O_3$—$PbTiO_3$), ZnO, or AlN.

14. The liquid circulation module according to claim 8, wherein the sub actuator comprises a first sub actuator and a second sub actuator, and the controller is further configured to drive the first sub actuator and the second sub actuator in different phases.

15. A liquid discharge apparatus, comprising:

an ink tank;

an inkjet head connected to the ink tank on a primary side and a secondary side thereof;

a diaphragm pump provided at least either between the secondary side of the ink tank and a primary side of the inkjet head or between the primary side of the ink tank and a secondary side of the inkjet head; and a drive device configured to drive the inkjet head, wherein the diaphragm pump comprising:

a main liquid chamber;

a main actuator configured to change a volume of the main liquid chamber;

a sub liquid chamber configured to communicate with a primary side or a secondary side of the main liquid chamber;

a sub actuator configured to change a volume of the sub liquid chamber;

a first check valve provided on the primary side of the main liquid chamber;

a second check valve provided on the secondary side of the main liquid chamber; and a controller configured to control the main actuator and the sub actuator.

16. The liquid apparatus according to claim 15, wherein the sub liquid chamber and the sub actuator are respectively provided on the primary side and the secondary side of the main actuator.

17. The liquid discharge apparatus according to claim 15, wherein the main actuator and the sub actuator individually comprise piezoelectric members.

18. The liquid discharge apparatus according to claim 15, wherein the controller controls an operation of the sub actuator to decrease a volume of the sub liquid chamber when the main actuator performs an operation of increasing the volume of the main liquid chamber, and controls an operation of the sub actuator to increase a volume of the sub liquid chamber when the main actuator performs an operation of decreasing the volume of the main liquid chamber.

19. The liquid discharge apparatus according to claim 15, wherein the piezoelectric members comprise lead zirconate titanate, lead titanate, PMNT (Pb $(Mg_{1/3}Nb_{2/3})O_3$—$PbTiO_3$), PZNT (Pb $(Zn_{1/3}Nb_{2/3})O_3$—$PbTiO_3$), ZnO, or AlN.

20. The liquid discharge apparatus according to claim 15, wherein the sub actuator comprises a first sub actuator and a second sub actuator, and the controller is further configured to drive the first sub actuator and the second sub actuator in different phases.

* * * * *